US005456810A

United States Patent [19]

Kawasaki et al.

[11] Patent Number: 5,456,810

[45] Date of Patent: Oct. 10, 1995

[54] METHODS OF MEASURING AND CONTROLLING ACTIVITY OF ZINC PHOSPHATE TREATMENT SOLUTION

[75] Inventors: Isao Kawasaki; Tamotsu Sobata, both of Osaka, Japan

[73] Assignee: Nippon Paint Co., Ltd., Osaka, Japan

[21] Appl. No.: 194,574

[22] Filed: Feb. 10, 1994

[30] Foreign Application Priority Data

Feb. 12, 1993 [JP] Japan ..... 5-023850

[51] Int. Cl.[6] ..... G01N 27/26

[52] U.S. Cl. ..... 204/153.13; 204/153.15; 204/153.1

[58] Field of Search ..... 204/153.13, 153.15, 204/153.1; 205/81, 98, 101, 323, 324

[56] References Cited

U.S. PATENT DOCUMENTS 3,329,587 7/1967 Steinbrecher et al. ..... 204/153.13
3,573,174 3/1971 Caro ..... 204/153.13
3,681,207 8/1972 Russell ..... 204/153.13
4,263,104 4/1981 Diggens et al. ..... 204/153.13
5,211,769 5/1993 Sobata et al. ..... 148/260

FOREIGN PATENT DOCUMENTS 0564287 4/1993 European Pat. Off. .

*Primary Examiner*—John Niebling
*Assistant Examiner*—Bruce F. Bell
*Attorney, Agent, or Firm*—Townsend & Banta

[57] ABSTRACT

A prescribed amount of a simple fluoride is added to a zinc phosphate treatment solution, which is a target solution, the HF concentration in the target solution is measured with a silicon electrode meter after the addition, and the concentration of the consumed HF is calculated to evaluate the activity of the target solution, for adding the simple fluoride to the zinc phosphate treatment solution so that its activity is in a control reference range.

9 Claims, 2 Drawing Sheets

METHODS OF MEASURING AND CONTROLLING ACTIVITY OF ZINC PHOSPHATE TREATMENT SOLUTION

BACKGROUND OF THE INVENTION

1. Field of the Invention

The present invention relates to methods of measuring and controlling an activity of a zinc phosphate treatment solution for forming a zinc phosphate coating on a surface of an aluminum member or an aluminum alloy member, and more specifically, it relates to methods of measuring and controlling an activity of a zinc phosphate treatment solution which contains complex hydrofluoric acid as an active material.

2. Description of the Background Art

In the field of a material for an automobile body or the like, employment of aluminum or an aluminum alloy material is carried out in practice or studied for the purpose of reduction in weight. In such use, a coating film may be formed by electrodeposition coating such as cationic electrodeposition coating. In order to improve the coating film in adhesion and corrosion resistance, a zinc phosphate coating is generally formed on a surface of the material as a pretreatment for the electrodeposition coating. Such a zinc phosphate coating is formed on the aluminum material by a method such as that disclosed in Japanese Patent Publication No. 45-16566 (1970), for example. According to this method, a zinc phosphate coating is formed by a zinc phosphate treatment solution containing zinc ions, nitrate ions, phosphate ions, $SiF_6$ ions, iron (II) ions and F ions as main components. When such a zinc phosphate treatment solution contains $SiF_6$ ions and F ions in the form of $H_2SiF_6$ and HF, the surface of the aluminum material is etched and activated through the following chemical formulas:

$$2Al+3H_2SiF_6 \rightarrow Al_2(SiF_6)_3+3H_2$$

$$Al+3HF \rightarrow AlF_3+3/2H_2$$

As understood from the above chemical formulas, HF and $H_2SiF_6$ react with aluminum in the zinc phosphate coating treatment, to form respective aluminum salts. Consequently, free HF and $H_2SiF_6$ concentration levels are reduced by the treatment, leading to reduction of activity levels with respect to the aluminum material. In order to control these activity levels so that the zinc phosphate treatment solution regularly has constant activity, it is necessary to measure the free HF and $H_2SiF_6$ concentration levels.

The HF concentration can be measured with a silicon electrode meter, for example. U.S. Pat. No. 3,S29,587 discloses a method of measuring free HF concentration with such a silicon electrode meter. According to this method, an electrolytic current with a constant voltage is fed across an inactive cathode and an anode of P-type silicon provided in an electrolytic cell which is filled up with a target solution, for measuring the HF concentration in the target solution from the current density. As to $F^-$ ions contained in the zinc phosphate treatment solution, it is possible to measure the concentration by diluting the treatment solution containing fluorine ions to about 20 to 200 times in volume and employing a fluorine ion electrode, as disclosed in Japanese Patent Laying-Open No. 60 -251280 (1985).

However, the concentration of complex hydrofluoric acid such as $H_2SiF_6$ cannot be measured by the aforementioned silicon electrode meter or the fluorine ion electrode, and there has been no simple method of measuring the same.

When $H_2SiF_6$ reacts with aluminum, the corresponding salt is produced, as hereinabove described. Therefore, the treatment solution which is reduced in activity by the treatment contains $H_2SiF_6$ and $Al_2(SiF_6)_3$. Activity of such a treatment solution must be measured in the following manner, for example:

First, the zinc phosphate treatment solution of pH 2.8 to 3.5, for example, is diluted with a total ionic strength adjustment buffer solution (TISAB), and the total fluorine concentration in terms of F is measured by a fluorine ion electrode method.

The TISAB as employed is prepared by dissolving 58 g of sodium chloride for adjusting total ionic strength, 1 g of sodium citrate for masking polyvalent cations and 50 ml of glacial acetic acid for pH adjustment in about 500 ml of pure water, thereafter adding a 5N sodium hydroxide solution to the mixture with adjustment of its hydrogen ion concentration to pH 5.3 through a pH meter, and further adding pure water to the mixture to attain a quantity of 1000 ml.

It is possible to obtain the free $H_2SiF_6$ concentration by obtaining total fluorine concentration in the aforementioned manner and further measuring Al concentration in the zinc phosphate treatment solution by atomic absorption analysis or the like.

In order to return the reduced activity to the original level after such measurement, the complex hydrofluoric acid is supplemented in general. When the complex hydrofluoric acid is newly supplemented in such a manner, it is necessary to measure the Si concentration, in addition to the aforementioned total fluorine concentration and Al concentration. Consequently, the conventional method of measuring activity is extremely complicated and requires a long time.

Thus, generally awaited is a method which can simply and quickly measure activity of a zinc phosphate treatment solution which contains complex hydrofluoric acidas an active material, together with a method of controlling activity of the zinc phosphate treatment solution through this method.

SUMMARY OF THE INVENTION

An object of the present invention is to provide a method of simply and quickly measuring activity of a zinc phosphate treatment solution containing complex hydrofluoric acid such as $H_2SiF_6$ or $HBF_4$, and a method of controlling the activity.

The inventive method of measuring the activity is adapted to measure the activity of a zinc phosphate treatment solution, containing complex hydrofluoric acid as an active material, for forming a zinc phosphate coating on a surface of an aluminum member or an aluminum alloy member, and comprises a step of adding a prescribed amount of a simple fluoride to the target zinc phosphate treatment solution, and a step of evaluating the activity of the target solution by measuring HF concentration in the solution containing the as-added simple fluoride.

It is possible to simply measure the HF concentration in the target solution after addition of the simple fluoride with a silicon electrode meter, for example. The silicon electrode meter can be prepared from that disclosed in U.S. Pat. No. 3,329,587, for example. An exemplary device for measuring HF concentration with such a silicon electrode meter is Surf Proguard 101N (trade name) by Nippon Paint Co., Ltd. When such a silicon electrode meter is employed, the hydrogen ion concentration of the target solution is preferably adjusted to be not more than pH 2 so that the HF concentration is increased in the following equilibrium state with rightward progress of equilibrium:

$$H^+ + F^- \rightarrow HF$$

A pH adjuster for adjusting the hydrogen ion concentration of the solution to not more than pH 2 can be prepared from inorganic acid such as sulfuric acid, hydrochloric acid, nitric acid or phosphoric acid, or organic acid such as acetic acid, citric acid or tartaric acid. When the as-measured target solution is returned into a zinc phosphate treatment solution which is contained in a treatment vessel, the pH adjuster is preferably prepared from phosphoric acid or nitric acid serving as a component of the treatment solution.

The simple fluoride which is added to the target solution can be prepared from HF, NaF, $NaHF_2$, KF, $KHF_2$, $NH_4F$ and/or $NH_4HF_2$. These materials may be independently employed, or combined with each other.

A method of controlling the activity according to the present invention utilizes the inventive method of measuring the activity, and comprises a step of sampling a target solution from a zinc phosphate treatment solution, a step of adding a prescribed amount of a simple fluoride to the as-collected target solution, a step of measuring the HF concentration in the target solution containing the as-added simple fluoride thereby evaluating the activity of the target solution, and a step of adding the simple fluoride to the zinc phosphate treatment solution so that its activity is in a control reference range on the basis of the evaluation of the activity of the target solution, thereby adjusting the activity.

In the inventive method of measuring the activity, a prescribed amount of a simple fluoride is added to the target zinc phosphate treatment solution. When complex hydrofluoric acid is $H_2SiF_6$, $Al_2(SiF_6)_3$ is formed by reaction with aluminum, and the following reaction is caused if HF is added as the simple fluoride, for example:

$$Al_2(SiF_6)_3 + 12HF \rightarrow 2H_3AlF_6 + 3H_2SiF_6 \quad (I)$$

Reaction between the aluminum salt of the complex hydrofluoric acid and the simple fluoride progresses in the aforementioned manner, to consume the simple fluoride until the aluminum salt of the complex hydrofluoric acid disappears. Therefore, it is possible to measure the amount of the aluminum salt of the complex hydrofluoric acid and to evaluate the activity by adding an excess simple fluoride and measuring the residual part thereof as the HF concentration. The residual part of the simple fluoride can be simply measured with a silicon electrode meter or the like, as hereinabove described. A concentration range allowing only a small measurement error is preferably selected for measuring the HF concentration with a silicon electrode meter. When the Surf Proguard 101N is employed as the silicon electrode meter, a prescribed amount of the simple fluoride is preferably added to the target solution so that the residual part of the simple fluoride is in a concentration of 200 to 500 ppm calculated as HF.

The chemical equivalent of the simple fluoride as HF, which reacts with the aluminum salt of the complex hydrofluoric acid in the target solution, is six times that of the aluminum salt, whereby the concentration of the aluminum salt present in the as-treated target treatment solution is empirically presumed from the concentration of the complex hydrofluoric acid contained in the treatment solution, treatment conditions and the like. Therefore, it is possible to obtain the simple fluoride concentration corresponding thereto. Accordingly, it is possible to decide the prescribed amount of the simple fluoride added to the target solution by adding the simple fluoride concentration in a range measurable with a silicon electrode meter to the simple fluoride concentration corresponding to the aluminum salt in the target treatment solution.

As hereinabove described, the hydrogen ion concentration of the target solution for measurement of the HF concentration is preferably adjusted to not more than pH 2, so that it is possible to increase the free HF concentration and reduce the measurement error as hereinabove described. Further, a temperature for measuring the HF concentration is preferably set at a constant level. The measurement temperature can be properly set in a range of 20 to 60° C., for example.

Also when acid sodium fluoride ($NaHF_2$) is employed as the simple fluoride, complex hydrofluoric acid is similarly formed through the following reaction:

$$Al_2(SiF_6)_3 + 6NaHF_2 \rightarrow 2Na_3AlF_6 + 3H_2SiF_6 \quad (II)$$

Each of the above chemical formulas (I) and (II) is adapted to illustrate that complex hydrofluoric acid is formed by such a reaction, and the form of the aluminum fluoride salt is varied with hydrogen ion concentration in practice. When a simple fluoride such as NaF containing no hydrogen is employed, hydrogen is supplied from an acid component in the system, to form $H_2SiF_6$.

While the above description has been made with respect to complex hydrofluoric acid of $H_2SiF_6$, it is also possible to measure the activity of a treatment solution in a similar manner in relation to another complex hydrofluoric acid such as $HBF_4$.

The present invention is also applicable to a zinc phosphate treatment solution which contains a small amount of a simple fluoride in addition to complex hydrofluoric acid. In other words, it is possible to apply the present invention to a zinc phosphate treatment solution which contains a simple fluoride in a small amount allowing no measurement with a silicon electrode meter such as an HF concentration of not more than 50 ppm, for example, for measuring the activity of the treatment solution, i.e., the concentration levels of the simple fluoride and the complex hydrofluoric acid.

According to the inventive method of controlling the activity, a target solution is collected from a zinc phosphate treatment solution which is contained in a zinc phosphate treatment solution vessel, the activity of the target solution is measured by adding a simple fluoride thereto in the aforementioned manner, and the simple fluoride is added to the zinc phosphate treatment solution which is contained in the zinc phosphate treatment solution vessel on the basis of evaluation of the activity. Due to the addition of the simple fluoride, the aluminum salt of complex hydrofluoric acid contained in the zinc phosphate treatment solution is converted to complex hydrofluoric acid, so that the activity of the zinc phosphate treatment solution is within a control reference range.

In the method of controlling the activity according to the present invention, no complex hydrofluoric acid is supplemented but a simple fluoride is added to form complex hydrofluoric acid in the system so that its concentration is in a prescribed range, thereby maintaining the activity. Therefore, the treatment solution is not complicated in composition and can be economically used for a long period.

In the method of measuring the activity according to the present invention, it is possible to measure the concentration of complex hydrofluoric acid in a target solution, i.e., the activity, by adding a prescribed amount of a simple fluoride to the target solution and measuring the HF concentration therein after such addition. Therefore, it is possible to simply and quickly measure the activity of the zinc phosphate treatment solution.

In the method of controlling the activity according to the present invention, a simple fluoride is added to the zinc phosphate treatment solution so that its activity is within a control reference range on the basis of evaluation of the activity of the target solution measured in the aforementioned manner. According to the inventive method of controlling the activity, it is possible to simply and quickly measure the activity so that the zinc phosphate treatment solution regularly maintains a constant activity level, whereby it is possible to form a high-quality zinc phosphate coating with a constant finished appearance.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[EXAMPLE 1]

Samples of a zinc phosphate treatment solution shown in Table 1 were prepared so that different amounts of simple fluorides were stepwisely added thereto, and the electrolytic current values were measured with a silicon electrode meter for obtaining concentration values calculated as HF of the simple fluorides contained in the treatment solution samples. The silicon electrode meter was prepared from the aforementioned Surf Proguard 101N.

The simple fluorides, which were prepared from acid sodium fluoride, were added to the zinc phosphate treatment solution samples to be 150, 200, 250, 300, 350 and 400 ppm in HF concentration. Then, 2 ml of 50% sulfuric acid was added to 100 ml of each zinc phosphate treatment solution sample containing the as-added acid sodium fluoride, and the electrolytic current value was measured at 55° C.

TABLE 1

| | Concentration | | Point |
|---|---|---|---|
| Zn | 1000 | TA | 21.0 |
| Ni | 1000 | FA | 0.6 |
| Mn | 600 | — | — |
| $PO_4$ | 15000 | — | — |
| $NO_3$ | 6000 | — | — |
| $NO_2$ | 100 | — | — |
| $SiF_6$ | 1000 | — | — |

Referring to Table 1, "TA" indicates a total acidity, and "FA" indicates a free acidity. The free acidity (FA) and the total acidity (TA), which represent amounts (ml) of NaOH of 0.1N required for neutralizing solutions of 10 ml respectively, can be obtained by neutralization titration with indicators of Bromophenol Blue and phenolphthalein respectively.

Figure 1:
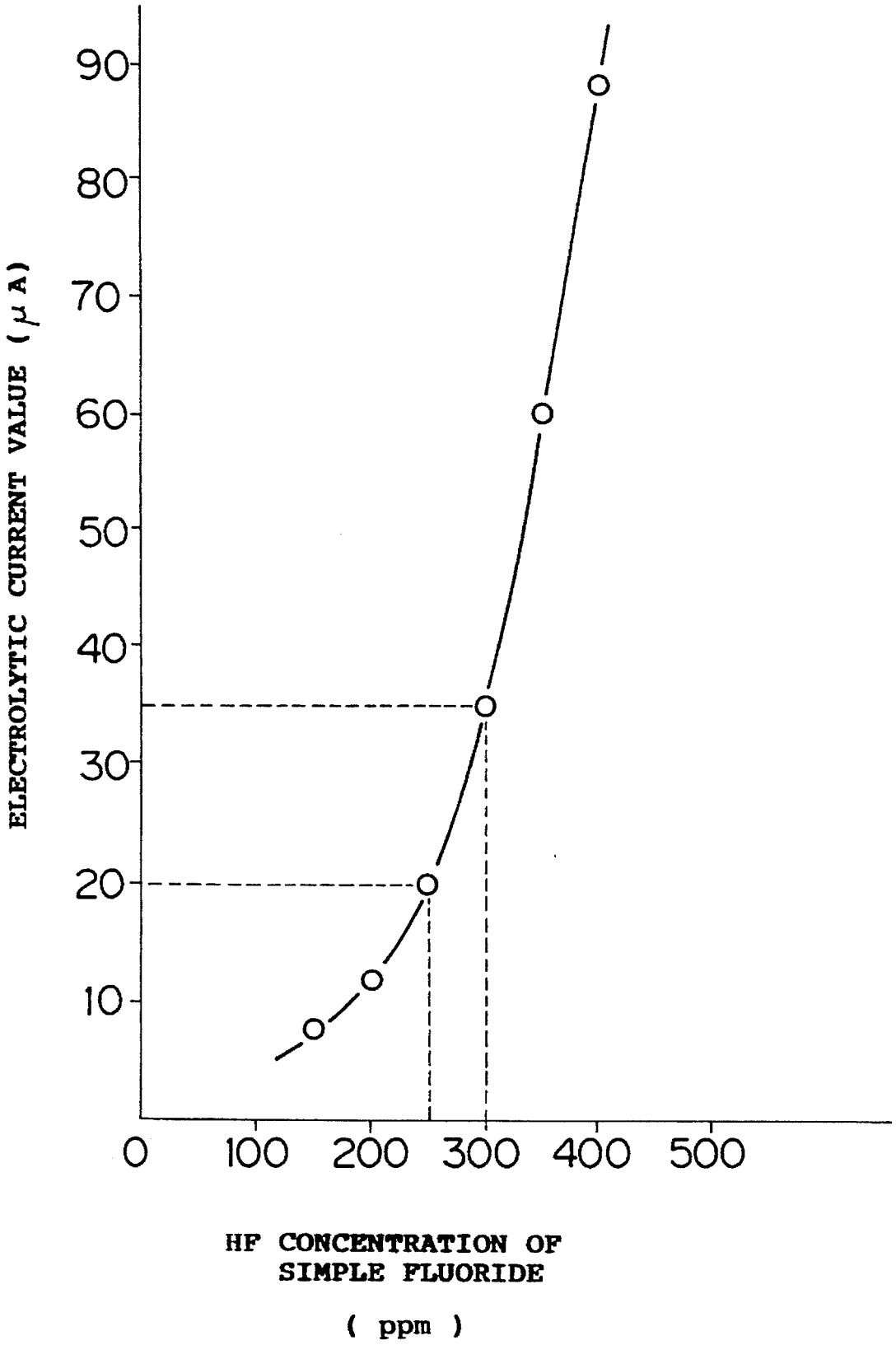
FIG. 1 is a graph showing relations between the concentration levels of simple fluorides which were added to unused zinc phosphate treatment solution samples whose activity levels were not reduced and the electrolytic current values of a silicon electrode meter.

FIG. 1 shows relations between the electrolytic current values and the simple fluoride concentration levels obtained in the aforementioned manner.

The curve as obtained can be employed as a calibration curve for the simple fluoride concentration levels in zinc phosphate treatment solutions.

The zinc phosphate treatment solution shown in Table 1 was employed to continuously treat a commercially available 5000-system (JIS) aluminum/magnesium alloy member. During the treatment, a sample of the treatment solution was collected every time a constant area of an alley member was treated. Acid sodium fluoride was added to each sample as collected by 400 ppm caluculated as HF, followed by addition of 50% sulfuric acid by 2 ml per 100 ml, and this mixture was subjected as a target solution to measurement of an electrolytic current value with Surf Proguard 101N. The as-measured electrolytic current values were converted to HF concentration levels along the calibration curve shown in FIG. 1. Table 2 shows the results.

Concentration values of complex fluoride aluminum salts contained in the as-collected zinc phosphate treatment solution samples were measured by a conventional method. Total fluorine concentration values were obtained by an fluorine ion electrode method using a total ionic strength adjustment buffer solution (TISAB) as hereinabove described to calculate the total $SiF_6$concentration values, and the $Al^{3+}$ concentration values were measured by atomic absorption to calculate the $Al_2(SiF_6)_3$ concentration values, thereby calculating the free $H_2SiF_6$ concentration values from the results. Table 2 also shows the results.

Coating properties of the collected zinc phosphate treatment solution samples for the aluminum member were also evaluated as follows:

○: with an amount of coating in excess of 1.0 g/m$^2$

Δ: with an amount of coating of 0.5 to 1.0 g/m$^2$

×: with an amount of coating of less than 0.5 g/m$^2$

TABLE 2

| $Al^{3+}$ Concentration (ppm) | | 0 | 10 | 50 | 100 |
|---|---|---|---|---|---|
| Electrolytic Current Value (μA) | | 88 | 65 | 12 | 10> |
| Residual $NaHF_2$ (in terms of HF) (ppm) | | 400 | 360 | 190 | 0 |
| Total $SiF_6$ | Concentration | 1000 | 1000 | 1000 | 1000 |
| Free $H_2SiF_6$ | in terms of | 1000 | 920 | 600 | 200 |
| $Al_2(SiF_6)_3$ | $H_2SiF_6$ (ppm) | 0 | 80 | 400 | 800 |
| Coating Property for Aluminum Member | | ○ | ○ | Δ | X |

It is understood from Table 2 that the free $H_2SiF_6$ concentration values were reduced and the amounts of aluminum salts were increased as the electrolytic current values were reduced as obtained by the Surf Proguard 101N, i.e., the concentration values of residual simple fluorides contained in the target solution samples were reduced. Further, it is also understood that the coating properties for the aluminum member were reduced in proportion to the free $H_2SiF_6$ concentration values. Thus, it is possible to simply and quickly evaluate the activity of a target zinc phosphate treatment solution by adding a prescribed amount of a simple fluoride to the target solution and measuring the HF concentration therein with a silicon electrode meter.

[EXAMPLE 2]

Figure 2:
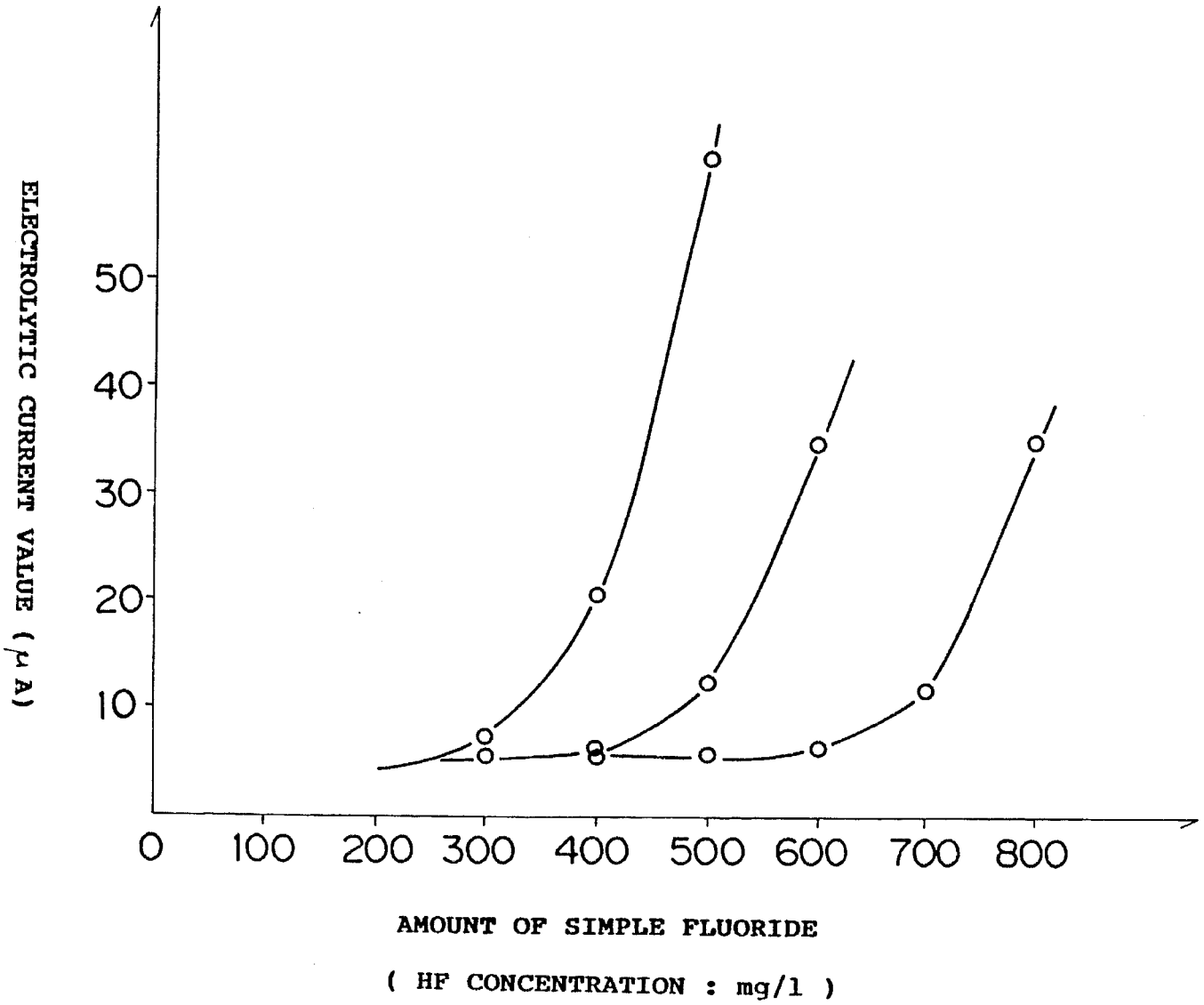
FIG. 2 illustrates the electrolytic current values which were measured when simple fluorides were stepwisely added to inactivated zinc phosphate treatment solutions in Example 2.

Description is now made on Example of adding simple fluorides to inactivated zinc phosphate treatment solutions for activating the same. Three types of inactivated zinc phosphate treatment solutions, which were inactivated by treating aluminum materials, were prepared. Acid sodium fluoride for serving as a simple fluoride was added to each treatment solution stepwisely by 300, 400, 500, 600, 700 and 800 ppm in HF concentration, and electrolytic current values were obtained with the Surf Proguard 101N. FIG. 2 shows relations between the amounts of the simple fluorides and the electrolytic current values.

As shown in FIG. 2, the amounts of the simple fluorides, which were added to the zinc phosphate treatment solutions so that the electrolytic current values reached constant values of 20 μA, for example, were different from each other. This is because aluminum salts of complex hydrofluoric acid existing in the respective treatment solutions were different in concentration from each other, and the electrolytic current values were not increased until all aluminum salts existing in the treatment solutions reacted with the simple fluorides. In other words, the electrolytic current values were not increased unless the equivalent weights of the as-added simple fluorides exceeded six times those of the aluminum salts existing in the treatment solutions.

Thus, it is possible to obtain aluminum salt concentration of complex hydrofluoric acid which is contained in a zinc phosphate treatment solution by stepwisely adding a simple fluoride thereto and measuring electrolytic current values, thereby obtaining a required amount calculated as HF of the simple fluoride for activating the inactivated zinc phosphate treatment solution.

[EXAMPLE 3]

Description is now made on Example of the inventive method of controlling activity.

The zinc phosphate treatment solution shown in Table 1 was employed to treat a commercially available No. 5000 aluminum/magnesium alloy member in the following steps:

(a) degreasing→(b) water rinse→(c) surface conditioning→(d) chemical conversion→(e) water rinse→(f) pure water rinse→(g) drying Treatment conditions for the respective steps were as follows:

(a) Degreasing

The sample was dipped in an aqueous solution containing 2 percent by weight of an alkaline degreasing agent ("Surf Cleaner SD250" by Nippon Paint Co., Ltd.) at 40° C. for two minutes. As to the bath control, alkalinity (expressed in an amount (ml) of HCl of 0.1N required for neutralizing a bath of 10 ml with an indicator of Bromophenol Blue) was maintained at an initial value. The Surf Cleaner SD250 was employed as a replenisher.

(b) Water Rinse

Service water was employed to spray-rinse the sample under a pump pressure.

(c) Surface Conditioning

The sample was dipped in an aqueous solution containing 0.1 percent by weight of a surface adjuster (Surf Fine 5N-5 by Nippon Paint Co., Ltd.) at the room temperature for 15 seconds. The bath was controlled by maintaining alkalinity with replenishment of Surf Fine 5N-5 similarly to the above.

(d) Chemical Conversion Treatment

The treatment solution was controlled by maintaining free acidity in the treatment solution (expressed in an amount (ml) of NaOH of 0.1N required for neutralizing a bath of 10 ml with an indicator of Bromophenol Blue) at an initial value. The treatment was performed at 40° C. for two minutes.

(e) Water Rinse

Service water was employed to rinse the sample at the room temperature for 15 seconds.

(f) Pure Water Rinse

The sample was dipped in ion-exchanged water at the room temperature for 15 seconds.

(g) Drying

The sample was dried with hot air of 100° C. for 5 minutes.

The sample was treated with zinc phosphate through the aforementioned steps, and concentrated replenishers A and B shown in Table 3 were employed for adjustment to maintain the activity of the zinc phosphate treatment solution at a constant level after the treatment.

TABLE 3

| Concentrated Replenisher A | |
|---|---|
| Zn | 8.4 g |
| $PO_4$ | 33.5 g |
| Ni | 1.5 g |
| Mn | 1.5 g |
| $SiF_6$ | 0.62 g |
| $NO_3$ | 1.5 g |
| Water | Residual Amount (Total: 100 g) |
| **Concentrated Replenisher B** | |
| Acid Sodium Fluoride | 2 g |
| Water | 98 g |

The concentrated replenisher A was added to the zinc phosphate treatment solution after the treatment, to maintain the free acidity shown in Table 1. The concentrated replenisher B was added to maintain the activity, i.e., the free $H_2SiF_6$ concentration, of the zinc phosphate treatment solution at the initial level of 1000 ppm. Acid sodium fluoride serving as a simple fluoride was added to 100 ml of the treatment solution collected from a treatment solution vessel by 300 ppm calculated as HF followed by addition of 2 ml of sulfuric acid (50 percent by weight) for adjusting hydrogen ion concentration to not more than pH 2, and thereafter an electrolytic current value was measured with a Surf Proguard 10iN measurer. The calibration curve shown in FIG. 1 was employed to obtain the HF concentration of simple fluoride in the solution from the electrolytic current value, and the concentrated replenisher B was added to the treatment solution contained in the treatment solution vessel for newly adding the simple fluoride by an amount obtained by subtracting the obtained concentration from the amount of 300 ppm of the simple fluoride which was added after the collection.

If a target solution collected from a zinc phosphate treatment solution vessel and supplied with the aforementioned prescribed amounts of a simple fluoride and sulfuric acid exhibits an electrolytic current value of 20 μA through a Surf Proguard 101N measurer, for example, it can be judged that the zinc phosphate treatment solution contained in the vessel contains $Al_2(SiF_6)_3$ by an amount corresponding to 50 ppm of the simple fluoride calculated as HF. Thus, the concentrated replenisher B may be added to the solution by an amount corresponding to 50 ppm of the simple fluoride calculated as HF.

Even if an aluminum alloy member is continuously treated, it is possible to form a high-quality zinc phosphate coating having constant finished appearance on the aluminum alloy member by controlling the free acidity and the activity of the treatment solution contained in a zinc phosphate treatment solution vessel in the aforementioned manner.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of measuring an activity of a zinc phosphate treatment solution, containing complex hydrofluoric acid as an active material, for forming a zinc phosphate coating on a surface of an aluminum member or an aluminum alloy member, said method comprising the steps of:

adding a set amount of a simple fluoride to said zinc phosphate treatment solution being a target solution, thereby to convert aluminum salt of said complex hydrofluoric acid in such zinc phosphate treatment solution to complex hydrofluoric acid evaluating the activity of said target solution by measuring HF concentration consumed by said conversion to complex hydrofluoric acid in said target solution; and adding said simple fluoride to said zinc phosphate treatment solution to adjust its activity to within a controlled reference range on the basis of said evaluation of the activity of said target solution, thereby adjusting said activity of said zinc phosphate treatment solution.

2. A method of measuring an activity of a zinc phosphate treatment solution in accordance with claim 1, wherein said HF concentration in said target solution is measured with a silicon electrode meter.

3. A method of measuring an activity of a zinc phosphate treatment solution in accordance with claim 1, further comprising a step of adding a pH adjuster to said target solution for adjusting the hydrogen ion concentration of said solution containing said simple fluoride as added to not more than pH 2.

4. A method of measuring an activity of a zinc phosphate treatment solution in accordance with claim 3, wherein said pH adjuster is phosphoric acid or nitric acid or both.

5. A method of measuring an activity of a zinc phosphate treatment solution in accordance with claim 1, wherein said simple fluoride is at least one material selected from the group consisting of HF, NaF, $NaHF_2$, KF, $KHF_2$, $NH_4F$ and $NH_4HF_2$.

6. A method of measuring an activity of a zinc phosphate treatment solution in accordance with claim 1, wherein said complex hydrofluoric acid is $H_2SiF_6$ or $HBF_4$ or both.

7. A method of measuring an activity of a zinc phosphate treatment solution in accordance with claim 1, wherein said step of adding a simple fluoride further comprises a step of adding said simple fluoride to said target solution so that a residual part of said simple fluoride is 200 to 500 ppm caluculated as HF after a reaction with a salt of said complex hydrofluoric acid.

8. A method of controlling an activity of a zinc phosphate treatment solution, containing complex hydrofluoric acid as an active material, for forming a zinc phosphate coating on a surface of an aluminum member or an aluminum alloy member in a control reference range, said method comprising the steps of:

sampling a target solution from said zinc phosphate treatment solution;

adding a set amount of a simple fluoride to said target solution as sampled;

measuring the HF concentration in said target solution containing said simple fluoride as added, thereby evaluating the activity of said target solution; and adding said simple fluoride to said zinc phosphate treatment solution so that its activity is within said control reference range on the basis of said evaluation of the activity of said target solution, thereby adjusting said activity of said zinc phosphate treatment solution.

9. A method of controlling an activity of a zinc phosphate treatment solution in accordance with claim 8, further comprising a step of returning said target solution to said original zinc phosphate treatment solution after said measurement.

* * * * *

UNITED STATES PATENT AND TRADEMARK OFFICE

CERTIFICATE OF CORRECTION

PATENT NO. : 5,456,810

DATED : October 10, 1995

INVENTOR(S) : Isao KAWASAKI, et al

It is certified that error appears in the above-indentified patent and that said Letters Patent is hereby corrected as shown below:

Column 9, lines 17-34, should read:

1. A method of measuring an activity of a zinc phosphate treatment solution, containing complex hydrofluoric acid as an active material, for forming a zinc phosphate coating on a surface of an aluminum member or an aluminum alloy member, said method comprising the steps of:

adding a set amount of a simple fluoride to said zinc phosphate treatment solution being a target solution, thereby to convert aluminum salt of said complex hydrofluoric acid in such zinc phosphate treatment solution to complex hydrofluoric acid evaluating the activity of said target solution by measuring HF concentration consumed by said conversion to complex hydrofluoric acid in said target solution; and adding said simple fluoride to said zinc phosphate treatment solution to adjust its activity to within a controlled reference range on the basis of said evaluation of the activity of said target solution, thereby adjusting said activity of said zinc phosphate treatment solution.

Signed and Sealed this

Thirtieth Day of April, 1996

Bruce Lehman

*Attest:*

BRUCE LEHMAN

*Attesting Officer*

*Commissioner of Patents and Trademarks*